United States Patent [19]

Bens et al.

[11] Patent Number: 5,001,384

[45] Date of Patent: Mar. 19, 1991

[54] ELECTRIC GAS DISCHARGE LAMP INCLUDING AN OUTER ENVELOPE AND SUPPORTING FRAME

[75] Inventors: Florentinus L. M. Bens; Robert R. M. Delen, both of Turnhout, Belgium

[73] Assignee: U.S. Philips Corporation, New York, N.Y.

[21] Appl. No.: 321,609

[22] Filed: Mar. 10, 1989

[30] Foreign Application Priority Data

Mar. 25, 1988 [NL] Netherlands ..... 8800752

[51] Int. Cl.[5] ..... H01J 61/34

[52] U.S. Cl. ..... 313/25

[58] Field of Search ..... 313/25

[56] References Cited

U.S. PATENT DOCUMENTS

| | | | |
|---|---|---|---|
| 2,080,925 | 5/1937 | Middleton et al. | 313/25 X |
| 2,152,997 | 4/1939 | Johnson | 313/25 X |
| 2,240,333 | 4/1941 | Hodge | 313/25 X |
| 2,755,405 | 7/1956 | Wilhelm | 313/404 |
| 3,445,721 | 5/1969 | Waymouth | 313/25 X |
| 3,706,901 | 12/1972 | de Neve | 313/634 X |
| 3,996,487 | 12/1976 | Hoeh | 313/25 |
| 4,766,338 | 8/1988 | King et al. | 313/25 |

FOREIGN PATENT DOCUMENTS

| | | | |
|---|---|---|---|
| 110747 | 6/1940 | Australia | 313/25 |

OTHER PUBLICATIONS

"Materials and Techniques for Electron Tubes", by W. H. Kohl, Reinhold Pub. Corp., N.Y., N.Y. (1962), pp. 227-230.

*Primary Examiner*—Palmer C. DeMeo

*Attorney, Agent, or Firm*—Brian J. Wieghaus

[57] ABSTRACT

Electric gas discharge lamp having a stem and a discharge vessel accommodated in an outer envelope. Resilient elements constituted by a bent wire piece are mounted on a free end portion to secure the frame and discharge vessel within the outer envelope. The bent wire pieces have a curved portion which engage the inner surface of the outer envelope which prevents scratching of the outer envelope during insertion of the stem frame into the outer envelope during lamp assembly.

6 Claims, 1 Drawing Sheet

ELECTRIC GAS DISCHARGE LAMP INCLUDING AN OUTER ENVELOPE AND SUPPORTING FRAME

BACKGROUND OF THE INVENTION

The invention relates to an electric gas discharge lamp comprising a discharge vessel which is mounted on a stem or frame said frame and discharge vessel being accommodated in an outer envelope, the frame having a free end portion on which resilient elements are mounted which are in resilient contact with the inner wall of the outer envelope.

A gas discharge lamp of the type described is known from U.S. Pat. No. 2,240,333.

The resilient elements of tape or strip-shaped metal ensure that the discharge vessel remains positioned with respect to the outer envelope and that shocks and vibrations to which the lamp is exposed are transferred to the discharge vessel to a minimum extent and that the stem or frame is in compliance with thermal expansion.

In such lamps the outer envelope often breaks prematurely. It has been found that this breakage is often due to the presence of scratches in the inner wall of the outer envelope. When the outer envelope breaks, the discharge vessel with its metal lead-throughs and connections is exposed to the ambient air and the lifetime of the lamp is reduced, notably by oxidation. The thermal control of the lamp is then also considerably affected. A reduced light output may be the result. Furthermore, unwanted ultraviolet radiation may emerge from the discharge vessel.

SUMMARY OF THE INVENTION

It is an object of the invention to provide a lamp having a simple and inexpensive construction eliminating the risk of scratches during and after mounting of the stem or frame in the outer envelope.

To realize the envisaged object the electric gas discharge lamp of the type described in the opening paragraph is characterized in that the resilient elements are constituted by a bent wire piece which between its ends engages the inner wall of the outer envelope.

In this way it is achieved that during and after mounting the stem in the outer envelope only a body without sharp edges is in contact with the inner wall of the outer envelope. This precludes scratches.

Although the risk of scratches is greatest in tubular outer envelopes due to the long path covered by the resilient elements moving along the inner wall of the outer envelope when mounting the stem, it is also certainly present in other forms of the outer envelope (for example ovoidal, with or without a dome).

In a favourable embodiment of the electric gas discharge lamp according to the invention the wire piece consists of manganese nickel. Variouus metals may be used for the wire piece, but manganese nickel has been found to be eminently suitable.

It is unimportant for the essence of the invention which type of gas discharge takes place in the discharge vessel.

BRIEF DESCRIPTION OF THE DRAWINGS

Embodiments of the lamp according to the invention will now be described with reference to the accompanying drawing in which.

DESCRIPTION OF THE PREFERRED EMBODIMENTS

The Figures are diagrammatic and not to scale.

Figure 1:
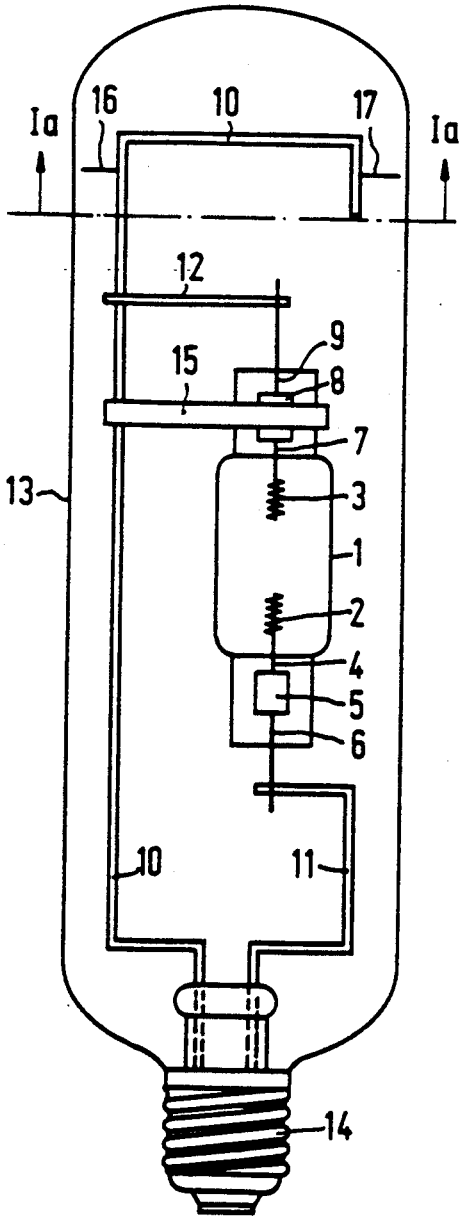
FIG. 1 is a side view of a high-pressure mercury vapour discharge lamp.
Figure 1A:
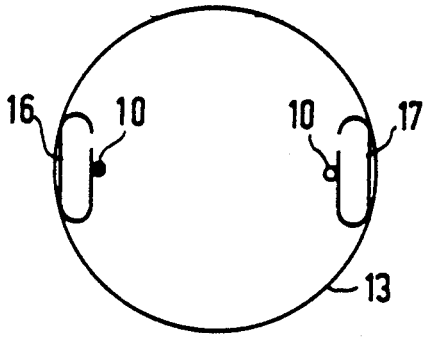
FIG. 1*a* is an elevational view taken on the line Ia—Ia in FIG. 1.

In FIG. 1 the reference numeral 1 denotes a quartz glass discharge vessel which is filled with mercury and a rare gas. Electrodes 2 and 3 are arranged in the discharge vessel 1. Electrode 2 is connected to current lead-through 4, 5, 6, the portion 6 of which is passed to the exterior through the wall of the discharge vessel 1. Electrode 3 is connected to current lead-through 7, 8, 9, the portion 9 of which is passed to the exterior through the wall of the discharge vessel 1. The discharge vessel 1 is mounted on a frame comprising the current conductors 10, 11 and 12. Current conductor 11 is connected to current lead-through 4, 5, 6 and current conductor 12 is connected to current lead-through 7, 8, 9. The stem 10, 11, 12 and discharge vessel 1 are accommodated in an evacuated tubular glass outer envelope 13. The current conductors 10 and 11 are passed to the exterior at one end through a wall of the outer envelope 13 and they are connected to an Edison lamp cap 14. The discharge vessel 1 is further supported by a holder 15 which surrounds one end of the vessel and is welded to the current conductor 10. At the free end of current conductor 10 two resilient, bent wire pieces 16 and 17 respectively are welded at two different areas, which wire pieces are in resilient contact with the inner wall of the outer envelope 13. The bent wire pieces have a wire thickness of, for example 0.8 mm and preferably consist of manganese nickel. As is apparent from FIG. 1*a*, the wire pieces have a free inwardly bent end and the weld is present at the other end. At the area of the two bends the wire pieces contact the inner wall of the outer envelope 13. This precludes scratching, both when mounting the stem 10, 11, 12 in the outer envelope 13 and afterwards, in the mounted state. Breakage of the outer envelope 13 due to scratching therefore does not occur.

Figure 2:
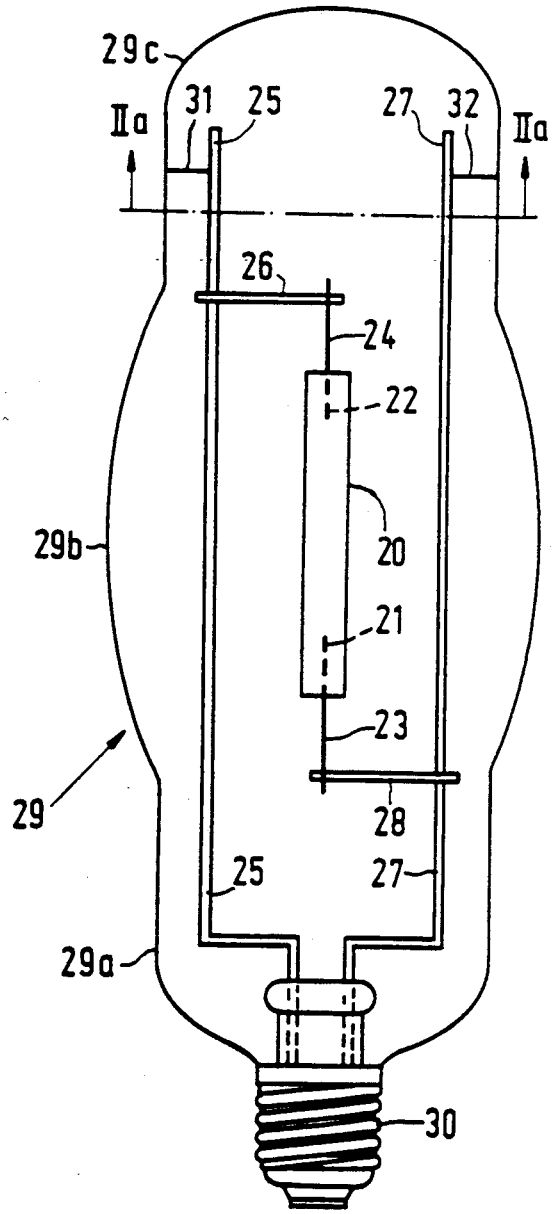
FIG. 2 is a side view of a high-pressure sodium vapour dischrage lamp.
Figure 2A:
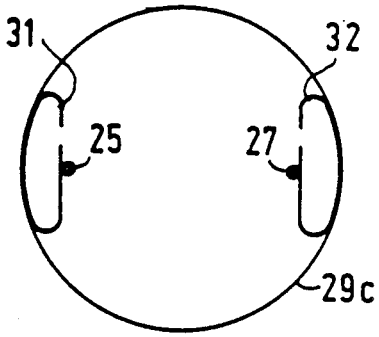
FIG. 2*a* is an elevational view taken on the line IIa—IIa in FIG. 2.

In FIG. 2 the lamp has a ceramic discharge vessel 20 which is filled with sodium, mercury and a rare gas. Electrodes 21 and 22 are arranged in the discharge vessel 20. Electrode 21 is connected to a current lead-through 23 which is passed to the exterior through the wall of the discharge vessel 20. Electrode 22 is connected to a current lead-through 24 which is passed to the exterior through the wall of the discharge vessel 20. The discharge vessel 20 is mounted on a stem comprising the current conductors 25, 26, 27 and 28. Current conductor 26 is connected to current lead-through 24, whilst current conductor 28 is connected to current lead-through 23. The stem 25, 26, 27, 28 and the discharge vessel 20 are accommodated in an evacuated outer envelope 29 having a tubular portion 29*a*, an ovoidal intermediate portion 29*b* and a portion 29*c* in the form of a dome. At one end of the lamp the current conductors 25 and 27 are passed to the exterior through the wall of the outer envelope 29 and connected to an Edison lamp cap 30. A resilient, bent wire piece 31 is welded on the free end of the current conductor 25 and a resilient, bent wire piece 32 is welded on the free end of the current conductor 27. The wire pieces 31 and 32 are in resilient contact with the cylindrical inner wall of portion 29*c* of the outer envelope 29. FIG. 2*a* shows that the wire pieces 31 and 32 engage the inner wall over a large length. Also in this case the ends of the bent wire pieces are remote from the inner wall and scratching and hence breakage of the outer envelope 29 during and after mounting of the stem 25, 26, 27, 28 with the discharge vessel 20 is excluded.

What is claimed is:

1. In an electric gas discharge lamp having an outer envelope, a discharge vessel energizable for emitting light, a frame within said envelope for supporting said discharge vessel, and a pair of opposing resilient elements secured to said frame and in resilient contact with said outer envelope, the improvement comprising:

each resilient element consisting of a length of wire being fixed near one end to said frame, having a central portion in resilient contact with said outer envelope, and having a free end bent inwardly away from said envelope such that said free end does not scratch said envelope during at least one of insertion of said frame in said envelope and upon vibration of said frame during lamp life.

2. An electric gas discharge lamp as claimed in claim 1, wherein each resilient element consists of manganese nickel.

3. In an electric gas discharge lamp as claimed in claim 1, wherein said central portion has two spaced bends contacting said envelope.

4. In an electric gas discharge lamp as claimed in claim 3, wherein said wire length extends transversely to said lamp axis.

5. In an electric gas discharge lamp as claimed in claim 1, wherein said central portion has a continuous curved shape complementing said envelope.

6. In an electric gas discharge lamp as claimed in claim 5, wherein said wire length extends transversely to said lamp axis.

* * * * *